US010744761B2

(12) United States Patent
Ito et al.

(10) Patent No.: US 10,744,761 B2
(45) Date of Patent: Aug. 18, 2020

(54) LIQUID EJECTING APPARATUS

(71) Applicant: SEIKO EPSON CORPORATION, Tokyo (JP)

(72) Inventors: Sukehiro Ito, Nagano (JP); Kazunori Hiramatsu, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/260,192

(22) Filed: Jan. 29, 2019

(65) Prior Publication Data

US 2019/0232646 A1 Aug. 1, 2019

(30) Foreign Application Priority Data

Jan. 31, 2018 (JP) ..... 2018-015752

(51) Int. Cl.
*B41J 2/045* (2006.01)
*B41J 2/14* (2006.01)
(Continued)

(52) U.S. Cl.
CPC ..... *B41J 2/04581* (2013.01); *B41J 2/04541* (2013.01); *B41J 2/04543* (2013.01); *B41J 2/04588* (2013.01); *B41J 2/04593* (2013.01); *B41J 2/04596* (2013.01); *B41J 2/115* (2013.01); *B41J 2/14201* (2013.01);
(Continued)

(58) Field of Classification Search
CPC ..... B41J 2/04581; B41J 2/14201; B41J 2/04588; B41J 2/04541; B41J 2002/14491; B41J 2002/14241; B41J 2002/14362; B41J 2002/14419; B41J 2/04543; B41J 2/04593; B41J 2/04596; B41J 2/14233; B41J 2/15
See application file for complete search history.

(56) References Cited

U.S. PATENT DOCUMENTS 6,860,589 B2 3/2005 Tamura
2003/0085953 A1 5/2003 Hiramoto et al.

FOREIGN PATENT DOCUMENTS

JP 2000-190488 A 7/2000
JP 4218245 B2 2/2009
WO 2017/111065 A1 6/2017

OTHER PUBLICATIONS

IP.com search (Year: 2019).*
(Continued)

*Primary Examiner* — Lisa Solomon
(74) *Attorney, Agent, or Firm* — Global IP Counselors, LLP

(57) ABSTRACT

A first wiring supplies a first driving signal to one end of a first piezoelectric elements; a second wiring supplies a first voltage to the other end of the first piezoelectric element to allow the first voltage to maintain the other end of the first piezoelectric element to a common electric potential; a third wiring supplies a second driving signal to one end of a second piezoelectric elements; and a fourth wiring supplies a second signal to the other end of the second piezoelectric element to allow the second signal to maintain the other end of the second piezoelectric element to the common electric potential. The second wiring is arranged between the first wiring and the fourth wiring, the fourth wiring is arranged between the second wiring and the third wiring, and the second wiring and the fourth wiring are arranged between the first wiring and the third wiring.

9 Claims, 14 Drawing Sheets

(51) Int. Cl.
*B41J 2/15* (2006.01)
*B41J 2/115* (2006.01)

(52) U.S. Cl.
CPC .. *B41J 2/14233* (2013.01); *B41J 2002/14241* (2013.01); *B41J 2002/14362* (2013.01); *B41J 2002/14419* (2013.01); *B41J 2002/14491* (2013.01)

(56) References Cited

OTHER PUBLICATIONS

IP.com search (Year: 2020).*
The Extended European Search Report for the corresponding European Patent Application No. 19154428.7 dated Jun. 3, 2019.

* cited by examiner

FIG. 8

<OPERATION OF SELECTION PORTION>

| | PRINTING DATA SI | T1 | T2 | T3 | T4 |
|---|---|---|---|---|---|
| LARGE DOT | (1, 1) | ON | OFF | OFF | OFF |
| MEDIUM DOT | (0, 1) | OFF | ON | OFF | OFF |
| SMALL DOT | (1, 0) | OFF | OFF | ON | OFF |
| NO-RECORDING | (0, 0) | OFF | OFF | OFF | ON |

<WIRING ARRANGEMENT ACCORDING TO PRESENT EMBODIMENT>

FIG. 11

<DEGREES OF INFLUENCE FOR WIRING ARRANGEMENT ACCORDING TO PRESENT EMBODIMENT>

| | Com1 | Vbs1 | Vbs2 | Com2 | Com3 | Vbs3 | Vbs4 | Com4 |
|---|---|---|---|---|---|---|---|---|
| Com1 | | 0 | -1/2 | 1/3 | 1/4 | -1/5 | -1/6 | 1/7 |
| Vbs1 | 0 | | 1 | -1/2 | -1/3 | 1/4 | 1/5 | -1/6 |
| Vbs2 | -1/2 | 1 | | 0 | -1/2 | 1/3 | 1/4 | -1/5 |
| Com2 | 1/3 | -1/2 | 0 | | 1 | -1/2 | -1/3 | 1/4 |
| Com3 | 1/4 | -1/3 | -1/2 | 1 | | 0 | -1/2 | 1/3 |
| Vbs3 | -1/5 | 1/4 | 1/3 | -1/2 | 0 | | 1 | -1/2 |
| Vbs4 | -1/6 | 1/5 | 1/4 | -1/3 | -1/2 | 1 | | 0 |
| Com4 | 1/7 | -1/6 | -1/5 | 1/4 | 1/3 | -1/2 | 0 | |

FIG. 12

〈DEGREES OF INFLUENCE ON EACH Com WHEN ATTENTION IS PAID TO PAIRS〉

| | Com1 | Com2 | Com3 | Com4 |
|---|---|---|---|---|
| Com1 Vbs1 | | -1/6 | -1/12 | -1/42 |
| Vbs2 Com2 | -1/6 | | 1/2 | 1/20 |
| Com3 Vbs3 | 1/20 | 1/2 | | -1/6 |
| Vbs4 Com4 | -1/42 | -1/12 | -1/6 | |
| DEGREE OF INFLUENCE (TOTAL) | -0.140 | 0.250 | 0.250 | -0.140 |

FIG. 14

<DEGREES OF INFLUENCE FOR WIRING ARRANGEMENT ACCORDING TO COMPARISON EXAMPLE>

| | Com1 | Vbs1 | Com2 | Vbs2 | Com3 | Vbs3 | Com4 | Vbs4 |
|---|---|---|---|---|---|---|---|---|
| Com1 | | 0 | 1/2 | -1/3 | 1/4 | -1/5 | 1/6 | -1/7 |
| Vbs1 | 0 | | -1 | 1/2 | -1/3 | 1/4 | -1/5 | 1/6 |
| Com2 | 1/2 | -1 | | 0 | 1/2 | -1/3 | 1/4 | -1/5 |
| Vbs2 | -1/3 | 1/2 | 0 | | -1 | 1/2 | -1/3 | 1/4 |
| Com3 | 1/4 | -1/3 | 1/2 | -1 | | 0 | 1/2 | -1/3 |
| Vbs3 | -1/5 | 1/4 | -1/3 | 1/2 | 0 | | -1 | 1/2 |
| Com4 | 1/6 | -1/5 | 1/4 | -1/3 | 1/2 | -1 | | 0 |
| Vbs4 | -1/7 | 1/6 | -1/5 | 1/4 | -1/3 | 1/2 | 0 | |

FIG. 15

〈DEGREES OF INFLUENCE ON EACH Com WHEN ATTENTION IS PAID TO PAIRS〉

| | Com1 | Com2 | Com3 | Com4 |
|---|---|---|---|---|
| Com1 Vbs1 | | -1/2 | -1/12 | -1/30 |
| Com2 Vbs2 | 1/6 | | -1/2 | -1/12 |
| Com3 Vbs3 | 1/20 | 1/6 | | -1/2 |
| Com4 Vbs4 | 1/42 | 1/20 | 1/6 | |
| DEGREE OF INFLUENCE (TOTAL) | 0.240 | -0.283 | -0.417 | -0.617 |

LIQUID EJECTING APPARATUS

This application claims priority to Japanese Patent Application No. 2018-015752 filed on Jan. 31, 2018. The entire disclosure of Japanese Patent Application No. 2018-015752 is hereby incorporated herein by reference.

BACKGROUND

1. Technical Field

The present invention relates to, for example, a liquid ejecting apparatus.

2. Related Art

Ink jet printers using piezoelectric elements have been well known as printing apparatuses that perform printing of images and/or documents by ejecting inks. The piezoelectric elements are typically piezo elements, and each of the piezoelectric elements is provided in such a way as to be associated with a corresponding one of a plurality of ejection portions in a print head. Each of these piezoelectric elements is driven in accordance with a driving signal in conjunction with the movement of the print head in a main-scanning direction and the transport of a recording target material in a sub-scanning direction, and this driving of the each piezoelectric element causes an ink (an liquid) having a given amount to be ejected through a corresponding one of nozzles at given timing.

Such a piezoelectric element is a capacitive load, such as a capacitor, from an electrical viewpoint, and thus, in order to cause a piezoelectric element corresponding to each of the nozzles to operate, it is necessary to supply sufficient current to the relevant piezoelectric element. In general, the configuration in which, in order to appropriately drive the piezoelectric elements provided in the print head that reciprocates along the main-scanning direction, driving signals are supplied from the side of a chassis of the printing apparatus to the print head via flexible flat cables (each being referred to as an FFC hereinafter) is employed.

In the case of such an ink jet printer, the operation area of a carriage mounting the print head is lengthened in proportional to the size of a medium, namely, the recording target material, along with the increase of the size of the medium, and this lengthening of the operation area of the carriage also causes the FFCs to be lengthened. With this lengthening of the FFCs, each of the wirings in the FFCs is likely to be subjected to influence, such as crosstalk or the like, due to currents flowing through other wirings. Thus, there is proposed a technique in which each of driving signals corresponding to a row and a corresponding one of ground signals corresponding to the same row as the above row are separated and allocated into mutually different FFCs in such a way as to face each other (see, for example, Japanese Patent No. 4218245).

The above technique, however, is based on the assumption that a plurality of FFCs is used. Further, in the case where such an ink jet printer for performing printing onto a large size medium is required to execute high-speed printing, since the plurality of lengthened FFCs is connected to the print head, the weight of the FFCs is increased. Further, this increase of the weight of the FFCs causes interference in the high-speed movement of the print head.

Further, in the above technique, when attention is paid to one FFC, a wiring for supplying a driving signal and a ground wiring line are arranged adjacent to each other, and thus, when attention is paid to only the above two wirings, the directions of currents flowing through the two wirings are opposite to each other, thus causing magnetic fields produced by the currents to be mutually compensated for, and thus, it seems that the influence of mutual inductance is reduced. In this regard, however, in the case where each of wirings for supplying a plurality of driving signals and each of a plurality of ground wirings are alternately arranged, for a certain pair of a wiring for supplying a driving signal and a wiring for a ground signal, all of the directions of influence of mutual inductance from other pairs of wirings are the same, and thus, the total of the degrees of influence of the mutual inductance from other pairs of wirings is rather increased.

For this reason, there has been a disadvantage in that, with the increase of the influence of mutual inductance, overshooting and/or undershooting occur (occurs) in a driving signal supplied to a piezoelectric element and thereby, the deviation from a target voltage value with respect to the voltage of the driving signal is increased, thereby not only making it difficult to accurately eject a target amount of ink, but also causing the performance of the piezoelectric element to be deteriorated because an overvoltage caused by the above increase of the deviation from the target voltage value is applied to the piezoelectric element.

SUMMARY

According to an aspect of the invention, a liquid ejecting apparatus includes a first ejection portion group including a plurality of first piezoelectric elements, each of the first piezoelectric elements being coupled to a first ejection portion configured to eject a first liquid in conjunction with driving of the each first piezoelectric element, a second ejection portion group including a plurality of second piezoelectric elements, each of the second piezoelectric elements being coupled to a second ejection portion configured to eject a second liquid in conjunction with driving of the each second piezoelectric element, a first wiring for supplying a driving signal to one end of the each first piezoelectric element to drive the each first piezoelectric element, a second wiring for supplying a signal having a predetermined electric potential to maintain an electric potential of another end of the each first piezoelectric element, a third wiring for supplying a driving signal to one end of the each second piezoelectric element to drive the each second piezoelectric element, and a fourth wiring for supplying a signal having a predetermined electric potential to maintain an electric potential of another end of the each second piezoelectric element. Further, the second wiring is arranged between the first wiring and the fourth wiring, the fourth wiring is arranged between the second wiring and the third wiring, and the second wiring and the fourth wiring are arranged between the first wiring and the third wiring.

In the liquid ejecting apparatus configured in this way, for the first wiring, the second wiring, the third wiring, and the fourth wiring, the variations of the voltages of the driving signals due to the mutual inductance are reduced, and thus, a liquid ejection failure and any other similar failure are reduced.

In the above aspect of the invention, the liquid ejecting apparatus may be configured to allow the first wiring, the second wiring, the third wiring, and the fourth wiring to be included in one flexible flat cable.

In a liquid ejecting apparatus, for flexible flat cables for supplying various kinds of signals to ejection portion groups, there is a tendency that a wiring pitch is short and individual wirings are lengthened. Even when such flexible flat cables are used, the above configuration reduces the variations of the voltages of the driving signals due to the mutual inductance.

In the above aspect of the invention, the liquid ejecting apparatus may be configured such that the first wiring is a wiring for supplying a driving signal to the each first piezoelectric element, and an amount of current flowing through the first wiring varies in accordance with the total number of piezoelectric elements which are included in the plurality of first piezoelectric elements and each of which is a target of the driving.

In a liquid ejecting apparatus whose statues ever-change in response to conditions, such as a liquid ejection amount and the like, it is difficult to predict the influence of the mutual inductance before driving each piezoelectric element. For this reason, it is difficult to employ a configuration in which the influence of the mutual inductance on the driving signal is predicted and the correction of the driving signal is made in such a way that the influence is compensated for in advance. In this respect, for the above configuration of the liquid ejecting apparatus, it is difficult to predict the amount of current flowing through the first wiring, but the above configuration of the liquid ejecting apparatus originally reduces the variation of the voltage of the driving signal due to the mutual inductance.

In the above aspect of the invention, the liquid ejecting apparatus may be configured such that the first ejection portion group includes a plurality of the first ejection portions whose total number is larger than or equal to three hundreds.

In the case where the total number of the ejection portions which are included in the first ejection portion group (the first piezoelectric elements) is larger than or equal to three hundreds, the amount of current flowing through the first wiring becomes large, and simultaneously therewith, it is difficult to predict the variation of the amount of the current. In this respect, however, the arrangement from the first wiring up to the fourth wiring according to the above configuration reduces the variations of the voltages of the driving signals due to the mutual inductance.

Further, in the above description about the disadvantage, and the like, the tendency that the wirings are lengthened has been mentioned. In this case, a specific apparatus needed to lengthen the first to fourth wirings is a liquid ejecting apparatus that supports ejecting of liquids onto a large size medium larger than or equal to a size A3. That is, in the above aspect of the invention, preferably, the liquid ejecting apparatus is configured to allow the first ejection portion and the second ejection portion to be configured to, while being moved relatively to each other, respectively eject the first liquid and the second liquid onto a medium having a size larger than or equal to a size A3.

BRIEF DESCRIPTION OF THE DRAWINGS

The invention will be described with reference to the accompanying drawings, wherein like numbers reference like elements.

FIG. 8 is a diagram illustrating the selection operation of a driving signal in the ink jet printer.

FIG. 11 is a diagram illustrating degrees of influence on each of wirings from other wirings in the FFC, according to the embodiment.

FIG. 12 is a diagram illustrating degrees of influence on each of driving signals when attention is paid to pairs in the FFC, according to the embodiment.

FIG. 14 is a diagram illustrating degrees of influence on each of wirings from other wirings in the FFC, according to the comparison example.

FIG. 15 is a diagram illustrating degrees of influence on each of driving signals when attention is paid to pairs in the FFC, according to the comparison example.

DESCRIPTION OF EXEMPLARY EMBODIMENTS

Hereinafter, an embodiment to practice the invention will be described with reference to the drawings. It should be noted that, in each of figures in relation to structure, the reduction scales and the reduced sizes of individual components are individually, appropriately changed from their original reduction scales and reduced sizes. Further, it should be noted that an embodiment described below is a preferred specific example of the invention, and thus, includes various preferred technical limitations given thereto; however, the scope of the invention is not limited to the embodiment described below unless, in the following description, there particularly exists any description stating the limitation of the invention.

Figure 1:
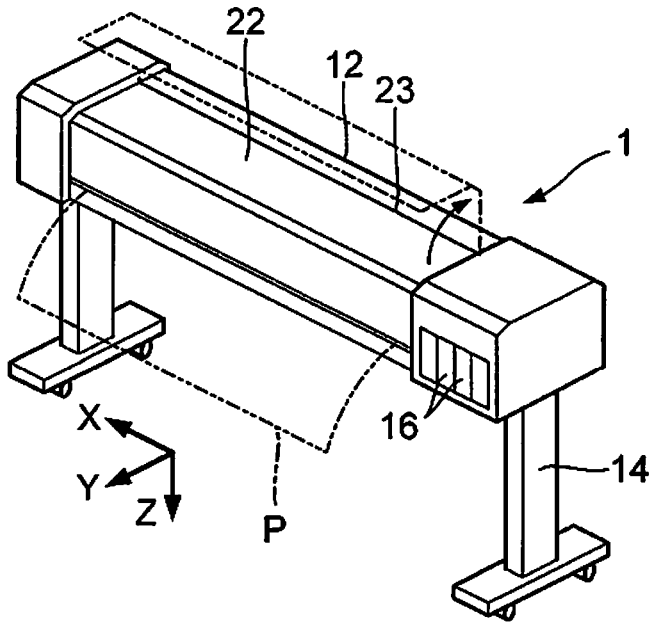
FIG. 1 is a perspective view of an ink jet printer according to an embodiment of the invention.

FIG. 1 is a diagram illustrating the configuration of an ink jet printer 1, namely, an ink jet printer as an example of a liquid ejecting apparatus according to an embodiment of the invention.

This ink jet printer 1 performs printing of images on the surface of a medium P by ejecting inks as an example of liquids onto the medium P. The medium P is paper, film, or the like that is a target of the ejection of the inks. The ink jet printer 1 is a printing apparatus (a large format printer (LFP)) capable of performing printing on the medium P of a large size larger than or equal to a size A3 in an international standard specification, and includes a housing 12 and leg portions 14, as illustrated in FIG. 1.

The housing 12 is a structural component having a long length along an X direction corresponding to the width direction of the medium P. In the present embodiment, a plurality of liquid reservoirs (cartridges) 16 is attached to the housing 12. Each of the liquid reservoirs 16 stores therein a corresponding one of mutually different kinds of inks. The leg portions 14 support the housing 12 at a predetermined height. Here, the plurality of liquid reservoirs 16 may be configured to store the in the same kind of ink.

In the following description, a vertical direction, namely, a direction in which gravity acts, will be referred to as a Z direction, and a direction perpendicular to an XZ plane, namely, a direction in which the medium P is transported, will be referred to as a Y direction. Further, in FIG. 1, a cover member 22 is a cover pivotally supported by a rotation shaft 23, namely, a rotation shaft extending in parallel to the X direction, and a user is capable of manually opening/closing of the cover member 22.

Figure 2:
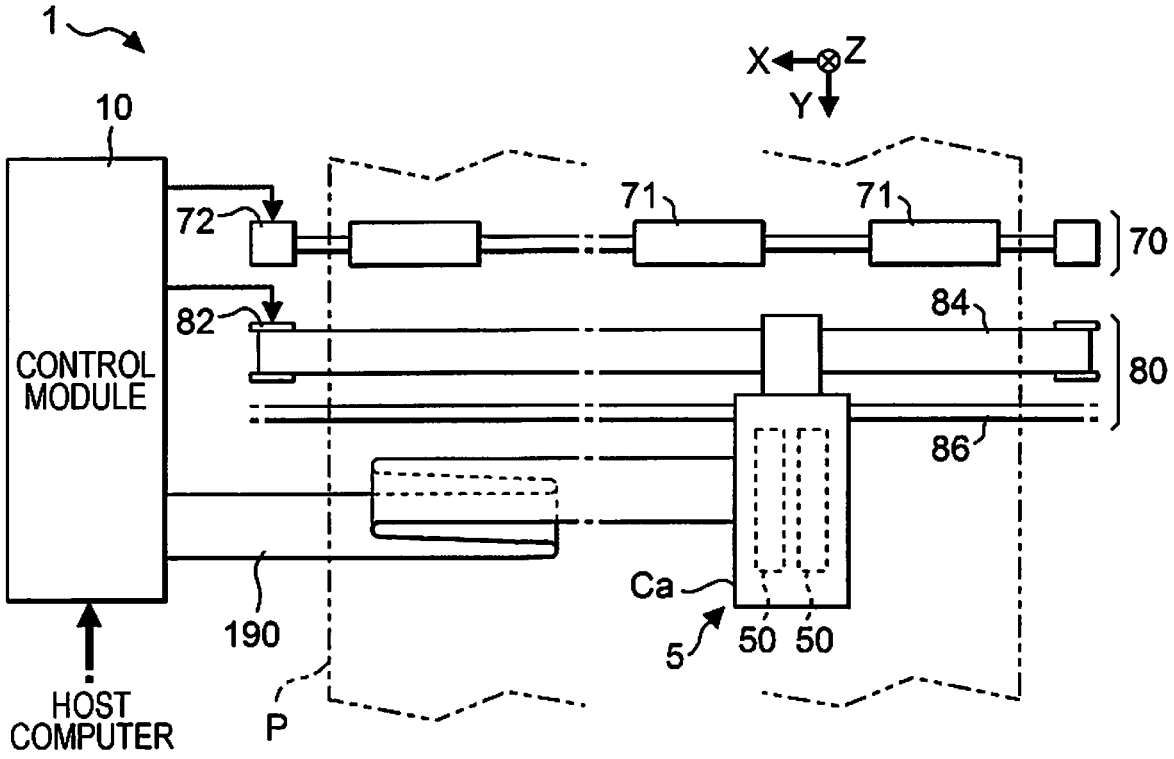
FIG. 2 is a diagram illustrating a configuration of the inside of the ink jet printer.

FIG. 2 is a diagram illustrating the configuration of the inside of the ink jet printer 1. As illustrated in FIG. 2, a control module 10, a transport mechanism 70, a carriage Ca, and a movement mechanism 80 are housed inside the ink jet printer 1. In the present embodiment, the carriage Ca mounts a head module 5, and this head module 5 includes two print heads 50.

Upon supply of image data from an external host computer, the control module 10 starts controlling of the individual elements (the print head 50, the transport mechanism 70, and the movement mechanism 80) in the ink jet printer 1 to perform printing of images prescribed by the image data on the medium P.

The transport mechanism 70 transports the medium P in the Y direction. Specifically, the transport mechanism 70 includes transport rollers 71 and a driving portion (for example, a motor) 72. The rotation axes of the transport rollers 71 are located in parallel to the X direction, and the driving portion 72 causes the transport rollers 71 to rotate under the control of the control module 10. Here, the transport mechanism 70 may be a mechanism configured to supply the medium P into the housing 12 by rotating a roll of the wound material P, or a mechanism configured to wind the medium P having been ejected from the housing 12.

The carriage Ca, which mounts the head module 5, is caused to reciprocate along the X direction by the movement mechanism 80. Specifically, the movement mechanism 80 includes an endless belt 84, a guide shaft 86, and a driving portion (for example, a motor) 82. The endless belt 84 is provided in a hanging manner along the X direction; the guide shaft 86 restricts the movement of the carriage Ca to a direction approximately parallel to the X direction; and the driving portion 82 drives the endless belt 84 under the control of the control module 10.

Here, the head module 5 is supplied with various kinds of driving signals and control signals, and the like, from the control module 10 via a flexible flat cable (FFC) 190, which has flexibility. As described above, the ink jet printer 1 according to the present embodiment supports printing on a large size medium, and thus, the operation area of the carriage Ca is lengthened.

Along with the lengthening of the operation area of the carriage Ca, the FFC 190 is also needed to be lengthened. In the present embodiment, the ink jet printer 1 is configured to be capable of printing on the medium P of a size larger than or equal to the size A3, and the upper limit value of the size is designed to be 75 inches. This is because, in the case where the size of the medium P exceeds 75 inches, the impedance elements of individual wirings in the FFC 190 become too large, thereby causing the drops of the voltages of driving signals to be increased, and these large drops of the voltages of the driving signals degrade the printing accuracy and the printing stability, and increase the possibility that erroneous ink ejections and the like occur.

Further, the head module 5 is supplied with not only the driving signals and the control signals via the FFC 190, but also the inks of individual colors from the respective liquid reservoirs 16 via tubes, the illustration of these tubes being omitted.

Figure 3:
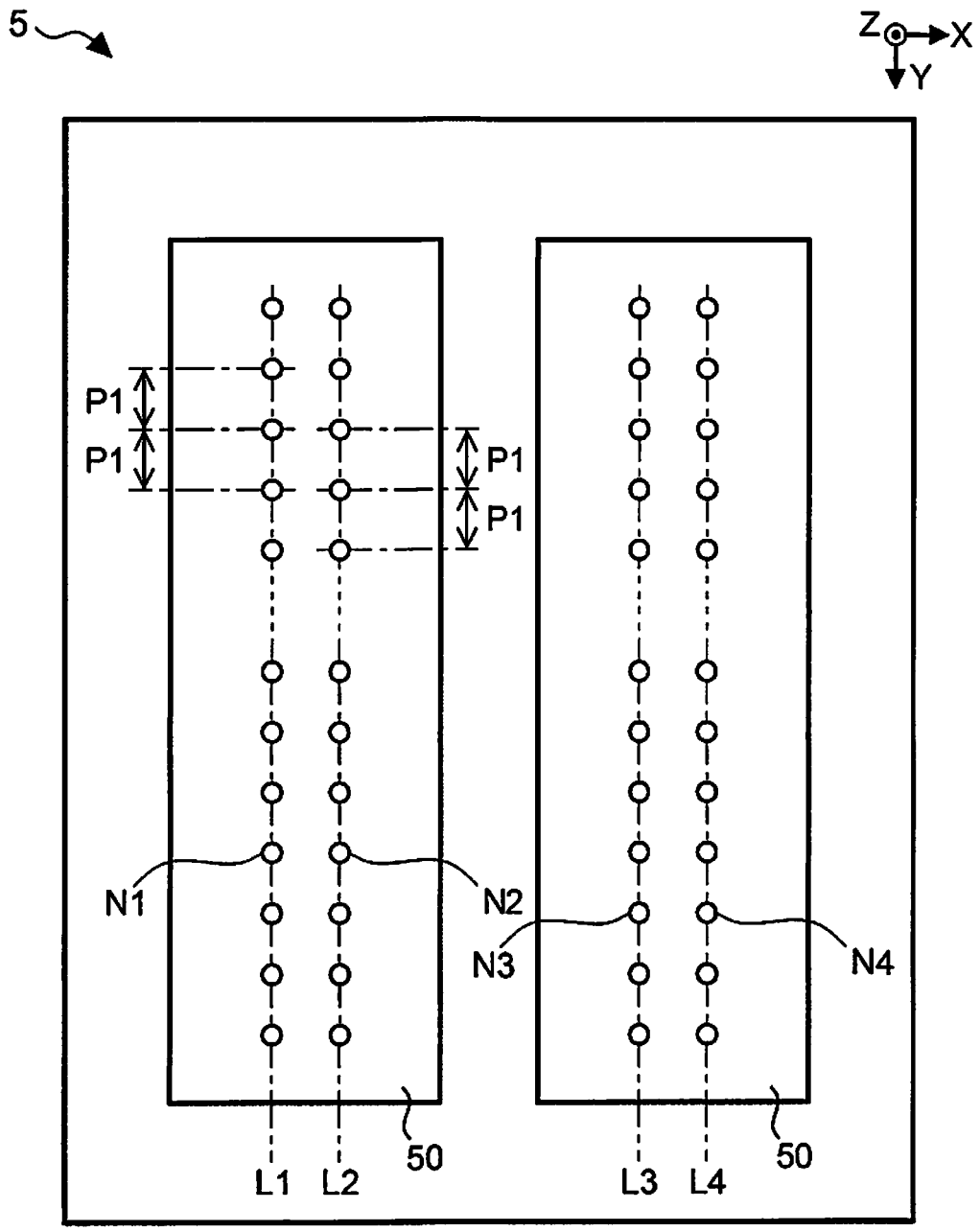
FIG. 3 is a diagram illustrating an example of the arrangement of nozzles in a head module of the ink jet printer.

FIG. 3 is a diagram illustrating the configuration of an ink ejection face of the head module 5 when the ink ejection face is seen from the side of the medium P. As illustrated in FIG. 3, the head module 5 includes two print heads 50 that are arrayed in such a way as to be arranged along the X direction. One print head 50 includes a first nozzle row composed of a plurality of m nozzles (m being an integer larger than or equal to "2") that are arranged with a pitch P1 along the Y direction, and a second nozzle row that, just like the first nozzle row, is composed of a plurality of m nozzles arranged with the pitch P1 along the Y direction. Thus, in the one print head 50, the number of the nozzles is 2 m, and the number of the nozzle rows is "2". Further, in the present embodiment, the head module 5 includes the two print heads 50, and thus, when attention is paid to the entire head module 5, the total number of the nozzles is 4 m, and the total number of the nozzle rows is "4".

For the convenience of description, in FIG. 3, in order to specify each of the four nozzle rows, the four nozzle rows are denoted by a row L1, a row L2, a row L3, and a row L4 in order from the left-hand side of FIG. 3. Further, nozzles belonging to the row L1, nozzles belonging to the row L2, nozzles belonging to the row L3, and nozzles belonging to the row 4 are respectively denoted by nozzles N1, nozzles N2, nozzles N3, and nozzles N4 in order from the left-hand side of FIG. 3, and generally-handled nozzles whose belonging rows are not needed to be identified are denoted by nozzles N.

For example, a black (Bk) ink is ejected though the nozzles N1 belonging to the row L1; a cyan (C) ink is ejected through the nozzles N2 belonging to the row L2; a magenta (M) ink is ejected through the nozzles N3 belonging to the row L3; and an yellow (Y) ink is ejected through the nozzles N4 belonging to the nozzle L4. Further, the rows L1 and L2 belong to the left-hand side print head 50 in FIG. 3, and the rows L3 and L4 belong to the right-hand side print head 50 in FIG. 3.

Here, in the example of FIG. 3, each of the nozzles N1 (N3), which belong to the row L1, (L3), and a corresponding one of the nozzles N2 (N4), which belong to the row L2 (L4), are configured to allow their respective Y-direction coordinates to approximately correspond to each other; however, the each of the nozzles N1 (N3) and the corresponding one of the nozzles N2 (N4) may be configured to be arrayed in such a way as to allow their respective Y-direction locations to differ from each other, that is, in such a way as to be arranged in a so-called zigzag shape or a so-called staggered shape.

Figure 4:
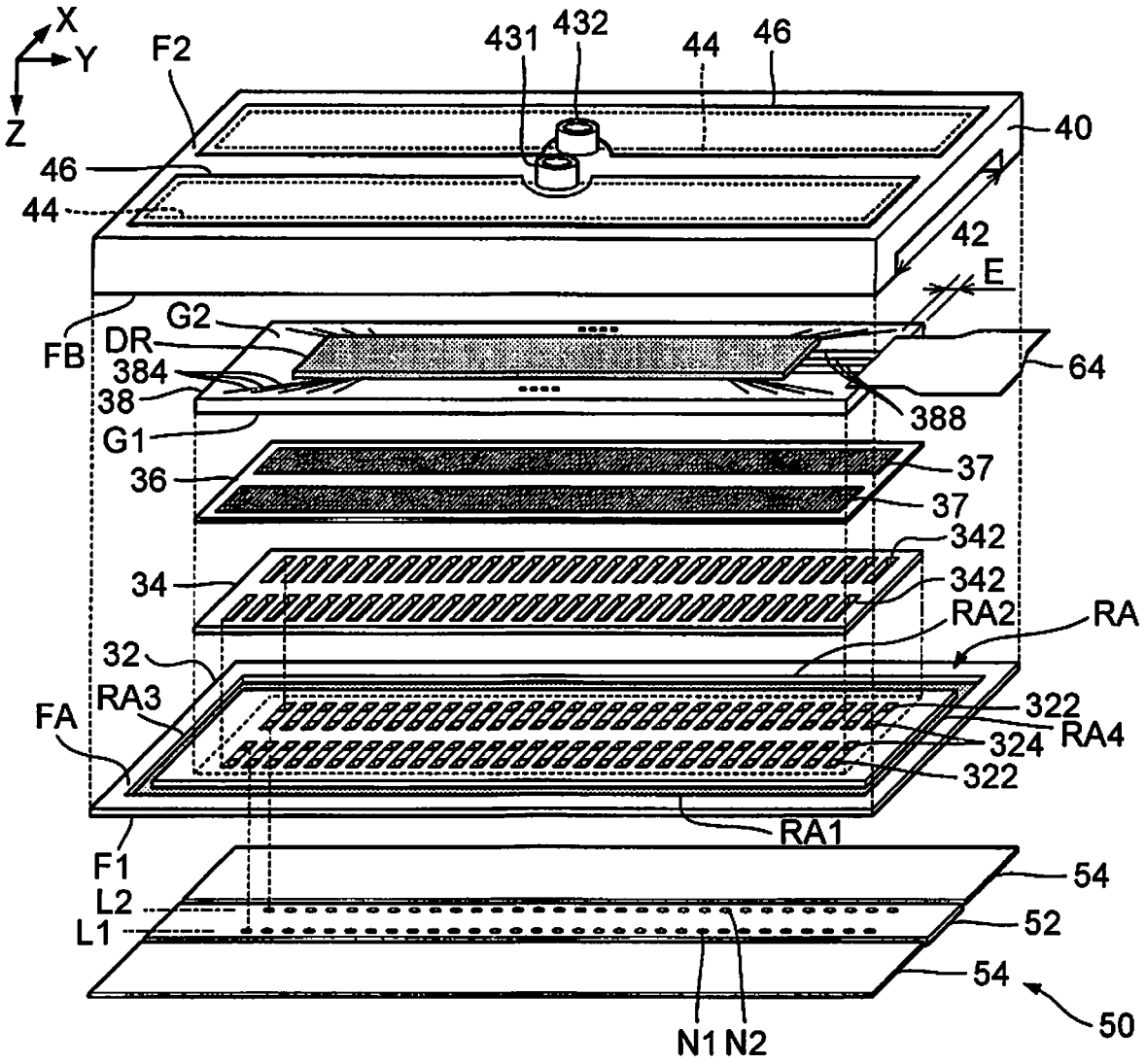
FIG. 4 is a disassembled perspective view of a print head included in the head module.
Figure 5:
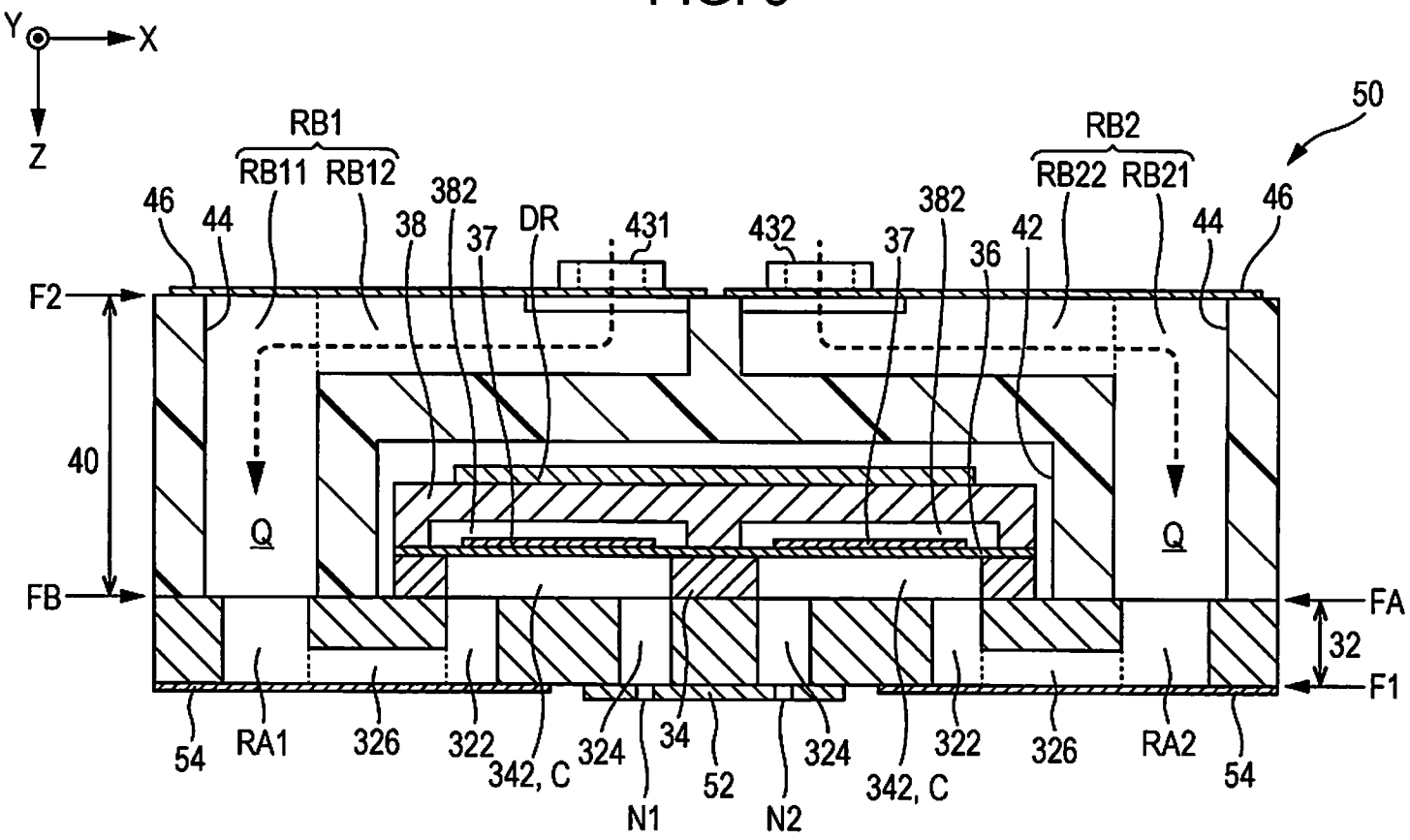
FIG. 5 is a cross-sectional view of the print head.

FIG. 4 is a disassembled perspective view of the print head 50 including nozzles corresponding to the rows L1 and L2, and FIG. 5 is a cross-sectional view of the print head 50, taken along an XZ plane in FIG. 4.

As illustrated in FIGS. 4 and 5, the print head 50 includes a flow path substrate 32. The flow path substrate 32 is a plate-shaped member including a face F1 and a face FA. The face F1 is a surface on the positive side of the Z direction, that is, a surface on the side of the medium P when seen from the print head 50; while the face FA is a surface on the side opposite the face F1 (namely, on the negative side of the Z direction). Further, a pressure chamber substrate 34, a vibration portion 36, a plurality of piezoelectric elements 37, a protection member 38, and a chassis portion 40 are placed on the surface of the face FA, and a nozzle plate 52 and vibration absorber portions 54 are placed on the surface of the face F1. The individual components of the print head 50 are schematically plate-shaped members that, similarly to the flow path substrate 32, have long lengths in the Y direction, and are joined to each other using, for example, an adhesive agent. Here, the direction in which the flow path substrate 32, the pressure chamber substrate 34, the protection member 38, and the nozzle plate 52 are stacked can be also understood as the Z direction.

The nozzle plate 52 is a plate-shaped member in which the 2 m nozzles N are formed, and is joined to the face F1 of the flow path substrate 32 using, for example, an adhesive agent. Each of the nozzles N is a penetration hole formed in the nozzle plate 52. The nozzle plate 52 is manufactured by processing a silicon (Si) single-crystal substrate utilizing, for example, a semiconductor manufacturing technique, such as edging or the like. Here, in the manufacturing of the nozzle plate 52, a known material and a known manufacturing method can be optionally employed.

In the present embodiment, in the nozzle plate 52, the m nozzles N1, which belong to the row L1, and the m nozzles N2, which belong to the row L2, are configured to, for each of the rows L1 and L2, be provided with a density larger than or equal to 300 nozzles per inch, across a length larger than or equal to 1 inch. That is, in the two rows L1 and L2, the nozzles N whose total number is larger than or equal to 600 are provided.

The flow path substrate 32 is a plate-shaped member for use in forming the flow paths of the inks. As illustrated in FIGS. 4 and 5, flow paths RA are formed in the flow path substrate 32. The flow paths RA include a flow path RA1, namely, a flow path disposed so as to correspond to the row L1; a flow path RA2, namely, a flow path disposed so as to correspond to the row L2; a flow path RA3, namely, a flow path that interconnects the flow path RA1 and the flow Path RA2; and a flow path RA4, namely, a flow path that interconnects the flow path RA1 and the flow path RA2. The flow path RA1 is an opening that is formed in a long shape along the Y direction. The flow path RA2 is located on the positive side of the X direction when seen from the side of the flow path RA1, and is an opening that is formed in a long shape along the Y direction.

In the flow path substrate 32, flow paths 322 and flow path 324 are formed in such a way that each of the nozzles N is associated with a corresponding one of the flow paths 322 and a corresponding one of the flow paths 324. As illustrated in FIG. 5, the flow paths 322 and the flow paths 324 are openings that are formed in such a way as to penetrate the flow path substrate 32. Each of the flow paths 324 communicates with a nozzle N corresponding to the each flow path 324.

Further, as illustrated in FIG. 5, two flow paths 326 are formed on the side of the face F1 of the flow path substrate 32. A first flow path 326 of the two flow paths 326 is a flow path that interconnects the flow path RA1 and each of the flow paths 322 that is associated with a corresponding one of the nozzles N1 belonging to the row L1, and a second flow path 326 of the two flow paths 326 is a flow path that interconnects the flow path RA2 and each of the flow paths 322 that is associated with a corresponding one of the nozzles N2 belonging to the row L2.

The pressure chamber substrate 34 is a plate-shaped member in which openings 342 are formed in such a way that each of the openings 342 is associated with a corresponding one of the nozzles N, and is joined to the face FA of the flow path substrate 32 utilizing, for example, an adhesive agent. The flow path substrate 32 and the pressure chamber substrate 34 are manufactured by processing a silicon (Si) single-crystal substrate utilizing, for example, a semiconductor manufacturing technique. Here, in the manufacturing of the flow path substrate 32 and the pressure chamber substrate 34, a known material and a known manufacturing method can be optionally employed.

The vibration portion 36 is disposed on a surface of the pressure chamber substrate 34, the surface being on the opposite side of the pressure chamber substrate 34 from the flow path substrate 32. The vibration portion 36 is a plate-shaped member capable of elastically vibrating. Here, for each region that is included in the plate-shaped member constituting the vibration portion 36 and that is associated with a corresponding one of the openings 342, part of a corresponding plate-thickness direction portion may be selectively removed to enable the pressure chamber substrate 34 and the vibration portion 36 to be formed integrally with each other.

As illustrated in FIG. 5, the face FA of the flow path substrate 32 and the vibration portion 36 face each other with a space therebetween inside each of the openings 342. The space located between the face FA of the flow path substrate 32 and the vibration portion 36 inside the each opening 342 functions as a pressure chamber C, namely, a pressure chamber for use in applying a pressure to an ink filled in the relevant space.

The pressure chamber C is a space having a long side along the X direction and a short side along the Y direction. In one print head 50, 2 m pressure chambers C are provided in such a way that each of the 2 m pressure chambers C is associated with a corresponding one of the 2 m nozzles N. As illustrated in FIG. 5, each pressure chamber C provided in such a way as to be associated with a corresponding one of the nozzles N1 communicates with the flow path RA1 via a corresponding one of the flow paths 322 and the first flow path 326, and simultaneously communicates with the corresponding one of the nozzles N1 via a corresponding one of the flow paths 324. Further, each pressure chamber C provided in such a way as to be associated with a corresponding one of the nozzles N2 communicates with the flow path RA2 via a corresponding one of the flow paths 322 and the second flow path 326, and simultaneously communicates with the corresponding one of the nozzles N2 via a corresponding one of the flow paths 324.

Meanwhile, the 2 m piezoelectric elements 37 are provided on a surface of the vibration portion 36, the surface being on the opposite side of the vibration portion 36 from the pressure chambers C, in such a way that each of the 2 m piezoelectric elements 37 is associated with a corresponding one of the 2 m pressure chambers C. Each of the piezoelectric elements 37 is an element whose deformation occurs in response to a corresponding supplied driving signal.

The vibration portion 36 vibrates in conjunction with the deformation of each of the piezoelectric elements 37. The vibration of the vibration portion 36 causes pressure inside a corresponding pressure chamber C to vary. Further, the increase/decrease of the pressure inside the relevant chamber C causes the ink filled in the relevant pressure chamber C to be ejected via a corresponding flow path 324 and a corresponding nozzle N. In the present embodiment, for example, each of the piezoelectric elements 37 is driven by a corresponding driving signal in such a way that the ink is ejected through a corresponding nozzle N over 30000 times per second.

Note that an ejection portion that is a physical mechanism for ejecting an ink is constituted by one of the pressure chambers C, a corresponding one of the flow paths 322, a corresponding one of the nozzles N, the vibration portion 36, and a corresponding one of the piezoelectric elements 37.

The protection member 38 is a plate-shaped member for protecting the 2 m piezoelectric elements 37, which are formed on the vibration portion 36, and is provided on the surface of the vibration portion 36 or the surface of the pressure chamber substrate 34. The protection member 38 is manufactured by processing a silicon (Si) single-crystal substrate utilizing, for example, a semiconductor manufacturing technique. Here, in the manufacturing of the protection member 38, a known material and a known manufacturing method can be optionally employed.

Further, two housing spaces 382 are formed on a face G1, namely, a Z-direction positive side surface of the protection member 38. One of the two housing spaces 382 is a space for housing the piezoelectric elements 37 each associated with a corresponding one of the nozzles N1, and the other one of the two housing spaces 382 is a space for housing the piezoelectric elements 37 each associated with a corresponding one of the nozzles N2. When the protection member 38 is disposed above the ejection portion, the housing spaces 382 function as sealing spaces for preventing the piezoelectric elements 37 from deteriorating due to the influence of oxygen, moisture, and/or the like. In this case, the Z-direction height of each of the housing spaces 382 has a size large enough not to cause the piezoelectric element 37 to be in contact with the protection member 38 even when the deformation of the piezoelectric element 37 occurs. For this reason, even when the deformation of the piezoelectric element 37 occurs, noise that arises along with the deformation of the piezoelectric element 37 is prevented from being propagated to the outside of the each housing space 382.

Meanwhile, a head drive DR is provided on a face G2, namely, a Z-direction negative side surface of the protection member 38. That is, the protection member 38 functions as a circuit substrate on which the head driver DR is mounted. The head driver DR switches the supply or non-supply of each of driving signals to a first end of a corresponding one of the piezoelectric elements 37 on the basis of printing data SI.

Here, the printing data SI is data for prescribing the size of each of dots that are formed on the medium P by the inks ejected through the nozzles N. In the present embodiment, when it is assumed a case where the size of the each dot is prescribed using four kinds of sizes (namely, four grayscale levels), namely, "a large size", "a medium size", "a small size", and "no dot", it follows that the printing data SI is prescribed, for each of the nozzles N, using two bits.

Note that, in the present embodiment, the driving signals are generated in the control module 10, but the invention is not limited this configuration, and the driving signals may be generated in the head driver DR. Further, second ends of the individual piezoelectric elements 37 are kept to a common electric potential Vbs by signals described later.

Further, wirings 384 are formed on the face G2 of the protection member 38 in such a way that, for example, each of the wirings 384 is associated with a corresponding one of the piezoelectric elements 37. One end of each of the wirings 384 is electrically connected to the head driver DR. The other end of the each of the wirings 384 is electrically connected to a corresponding one of connection terminals provided on the face G1 via a corresponding one of contact holes penetrating the protection member 38. Each of the connection terminals is electrically connected to one electrode of a corresponding one of the piezoelectric elements 37. Thus, each driving signal output from the head driver DR is supplied to the first end of a corresponding one of the piezoelectric elements 37, that is, more specifically, to the one electrode of two electrodes of the corresponding one of the piezoelectric elements 37, via a corresponding one of the wirings 384, a corresponding one of the contact holes, and a corresponding one of the connection terminals.

Further, a plurality of wirings 388 are formed on the face G2 of the protection member 38. One end of each of the plurality of wirings 388 is electrically connected to the head driver DR. The other end of each of the plurality of wirings 388 is extended up to a region E, namely, a Y-direction positive side end portion of the face G2 of the protection member 38. Further, a wiring member 64 is joined to the region E of the face G2. The wiring member 64 is a component in which a plurality of wirings for electrically interconnecting the control mechanism 20 and the head drivers DR are formed. As the wiring member 64, a flexible wiring substrate, such as a flexible printed circuit (FPC) or the like, may be employed.

The chassis portion 40 is a case for storing therein the inks supplied to the individual pressure chambers C, and further, the individual nozzles N. A face FB, namely, a Z-direction positive side surface of the chassis portion 40, is secured to the face FA of the flow path substrate 32 using, for example, an adhesive agent.

Further, a concave portion 42, namely, concave portion having a groove shape and extending in the Y direction, is formed on the face FB of the chassis portion 40. The protection member 38 and the head driver DR are housed inside the concave portion 42. The wiring member 64, which is joined to the region E of the protection member 38, extends in the Y direction in such a way as to pass through inside the concave portion 42.

In the present embodiment, the chassis portion 40 is formed of a material different from those of the flow path substrate 32 and the pressure chamber substrate 34. The chassis portion 40 is formed by, for example, injection molding of a resin material. Here, in the manufacturing of the chassis portion 40, a known material and a known manufacturing method can be optionally employed. As a material of the chassis portion 40, for example, synthetic fabric, such as poly para-phenylene benzobisoxazole (Zylon (trade mark)) or the like, or a resin material, such as liquid crystal polymer or the like, is suitable.

Further, introducing inlets 431 and 432 each for introducing an ink supplied from a corresponding one of the liquid reservoirs 16 via a corresponding one of paths, which are omitted from illustration, are provided on a face F2, namely, a Z-direction negative side surface of the chassis portion 40. Further, flow paths RB1 and RB2 are formed in the chassis portion 40. The flow path RB1 includes a flow path RB11 and a flow path RB12. The flow path RB11 communicates with the flow path RA1, and the flow path RB12 communicates with the introducing inlet 431. The flow path RB2 includes a flow path RB21 and a flow path RB22. The flow path RB21 communicates with the flow path RA2, and the flow path RB22 communicates with the introducing inlet 432.

The flow path RB1 and RB2 function as reservoirs Q, namely, reservoirs each for storing therein an ink supplied to a corresponding one of the pressure chambers C. Further, as illustrated in FIG. 5, the protection member 38 and the head driver DR are provided in a space between the flow path RB11 and the flow path RB21.

As illustrated by arrows of dashed lines in FIG. 5, an ink having been supplied from a corresponding one of the liquid reservoirs 16 to the introducing inlet 431 is flown into the flow path RA1 via the flow path RB12 and the flow path RB11. Further, part of the relevant ink having been flown into the flow path RA1 is supplied to the pressure chamber C corresponding to the nozzle N1 via the first flow path 326, and the flow path 322 corresponding to the nozzle N1. The relevant ink having been filled in the pressure chamber C corresponding to the nozzle N1 flows to, for example, the Z-direction positive side in the flow path 324 corresponding to the nozzle N1, and is ejected through the nozzle N1 by the deformation of the piezoelectric element 37 corresponding to the nozzle N1.

Similarly, another ink having been supplied from a corresponding one of the liquid reservoirs 16 to the introducing inlet 432 is flown into the flow path RA2 via the flow path RB22 and the flow path RB21. Further, part of the relevant ink having been flown into the flow path RA2 is supplied to the pressure chamber C corresponding to the nozzle N2 via the second flow path 326, and the flow path 322 corresponding to the nozzle N2. The relevant ink having been filled in the pressure chamber C corresponding to the nozzle N2 flows to, for example, the Z-direction positive side in the flow path 324 corresponding to the nozzle N2, and is ejected through the nozzle N2 by the deformation of the piezoelectric element 37 corresponding to the nozzle N2.

In addition to the above-described introducing inlets 431 and 432, openings 44, namely, openings each associated with a corresponding one of the reservoirs Q, are formed on the face F2 of the chassis portion 40. Further, two vibration absorbing materials 46 are provided on the face F2 of the chassis portion 40 in such a way as to close the openings 44. Each of the vibration absorbing materials 46 is a flexible film for absorbing the pressure variation of the ink inside a corresponding one of the reservoirs Q, and forms a wall face of the corresponding one of the reservoirs Q.

Further, two vibration absorbing materials 54 are provided on the face F1 of the flow path substrate 32, and each of the vibration absorbing materials 54 closes a corresponding one of the flow paths RA1 and RA2, a corresponding one of the first and second flow paths 326, and corresponding ones of the flow paths 322. Each of the vibration absorbing materials 54 is a flexible film for absorbing the pressure variation of the ink inside a corresponding one of the reservoirs Q, and forms a wall face of the corresponding one of the reservoirs Q.

Note that one print head 50 including nozzles corresponding to the rows L1 and L2 has been described heretofore, and further, another print head 50 including nozzles corresponding to the rows L3 and L4 has a similar structure. In this case, the color of an ink supplied to flow paths corresponding to the row L3 is magenta, and the color of an ink supplied to flow paths corresponding to the row L4 is yellow. Further, in the present embodiment, the inks ejected through the respective rows of the nozzles N are of mutually different kinds (colors), but may be of the same kind.

Next, an electric configuration of the ink jet printer 1 will be described below.

Figure 6:
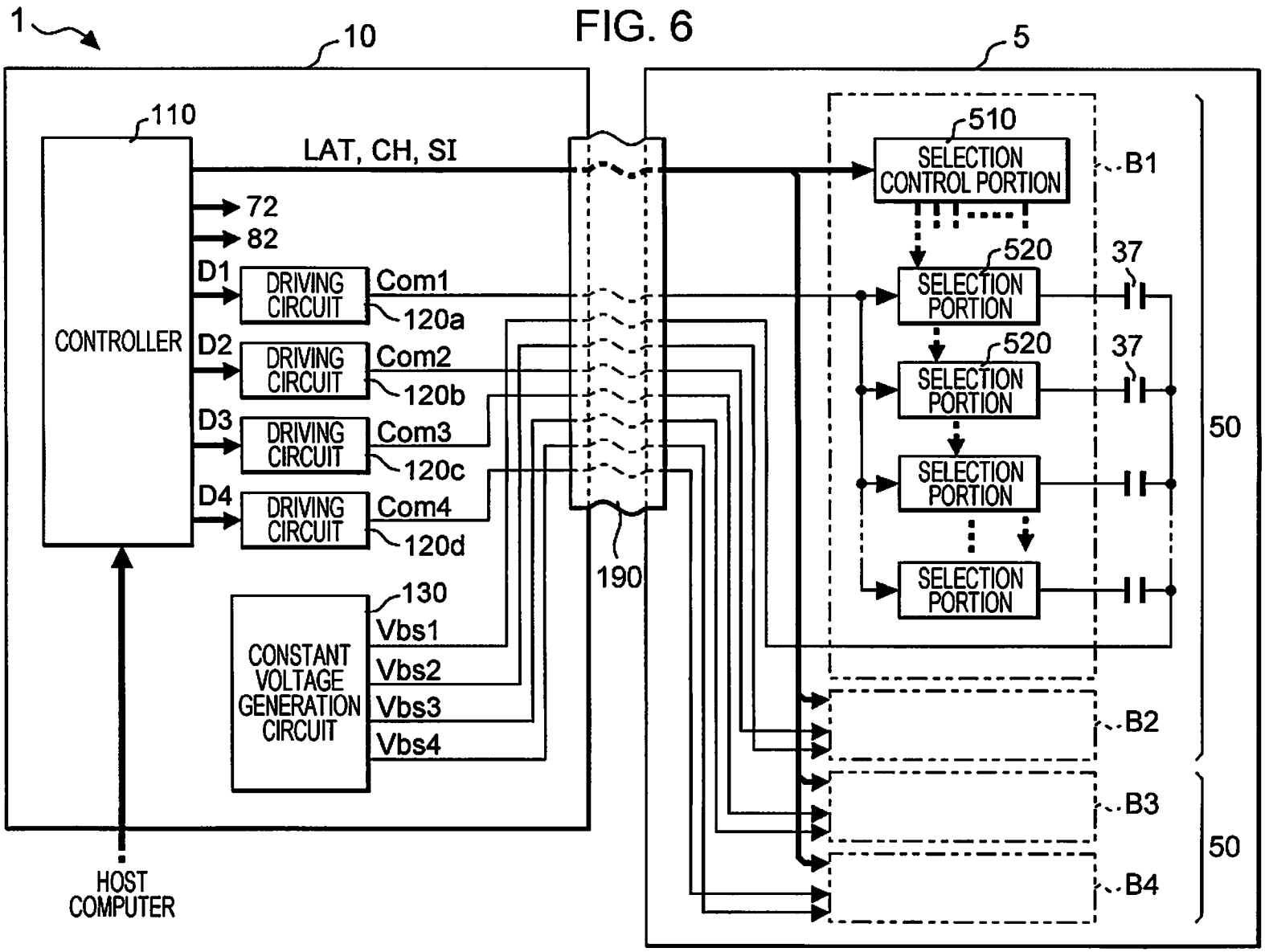
FIG. 6 is a block diagram illustrating an electric configuration of the ink jet printer.

FIG. 6 is a block diagram illustrating an electric configuration of the ink jet printer 1. As illustrated in FIG. 6, the ink jet printer 1 is configured such that the control module 10 and the head module 5 are connected to each other via the FFC 190.

Note that, in the head module 5, there are two print heads 50, and as a result, the number of rows of the nozzles N is "4". Thus, in FIG. 6, for the sake of convenience, circuit element groups for separately controlling the individual nozzle groups corresponding to the four rows are denoted by blocks B1, B2, B3, and B4. Specifically, a circuit element group for controlling the m nozzles belonging to the row L1 is the block B1; a circuit element group for controlling the m nozzles belonging to the row L2 is the block B2; a circuit element group for controlling the m nozzles belonging to the row L3 is the block B3; and a circuit element group for controlling the m nozzles belonging to the row L4 is the block B4. Here, the blocks B1 and B2 correspond to the circuit of the head driver DR mounted in one of the print heads 50, and the blocks B3 and B4 correspond to the circuit of the head driver DR mounted in the other one of the print heads 50.

As illustrated in FIG. 6, the control module 10 includes a controller 110, driving circuits 120*a*, 120*b*, 120*c*, and 120*d*, and a constant voltage generation circuit 130. The controller 110 among these components includes a processing circuit, such as a central processing unit (CPU), a field programmable gate array (FPGA), or the like, and storage circuits, such as a semiconductor memory and the like. Upon supply of image data from a host computer or the like, the controller 110 outputs various kinds of signals for controlling individual elements of the ink jet printer 1 in order to perform printing of images prescribed by the image data onto the medium P.

Specifically, when performing printing, firstly, the controller 110 controls the transport mechanism 70 to execute sub-scanning of the medium P by outputting a control signal to the driving portion 72 and, in parallel therewith, controls the movement mechanism 80 to execute main-scanning of the carriage Ca by outputting a control signal to a driving portion 82.

Secondly, in synchronization with the control of the transport mechanism 70 and the control of the movement mechanism 80, the controller 110 supplies the printing data SI for prescribing the amounts of the inks to be ejected through the nozzles N, and control signals LAT and CH, namely, control signals for prescribing a printing cycle and the like, to each of the blocks B1, B2, B3, and B4 via the FFC 190.

Thirdly, in synchronization with the control of the transport mechanism 70 and the control of the movement mechanism 80, the controller 110 outputs data D1, data D2, data D3, and data D4. The data D1 is data for prescribing a driving signal Com1; the data D2 is data for prescribing a driving signal Com2; the data D3 is data for prescribing a driving signal Com3; and the data D4 is data for prescribing a driving signal Com4.

The driving circuit 120*a* generates the driving signal Com1 on the basis of the data D1. More specifically, the driving circuit 120*a* converts the data D1 into an analog signal, and then, outputs a signal resulting from D-class amplification of the analog signal, as the driving signal Com1.

Similarly, the driving circuit 120*b* generates the driving signal Com2 on the basis of the data D2; the driving circuit 120*c* generates the driving signal Com3 on the basis of the data D3; and the driving circuit 120*d* generates the driving signal Com4 on the basis of the data D4. Note that, in the following description, in the case where it is unnecessary to specify which of the driving signals Com1 to Com4 the driving signal is, the relevant driving signal may be referred to as "a driving signal" followed by "Com" in parentheses, that is, "a driving signal (Com)".

The constant voltage generation circuit 130 generates signals Vbs1, Vbs2, Vbs3, and Vbs4, namely, signals for keeping the second ends of the plurality of piezoelectric elements 37 to a mutually common state, that is, the electric potential Vbs. In this case, the constant generation circuit 130 generates each of the signals Vbs1, Vbs2, Vbs3, and Vbs4 using, for example, a corresponding one of four mutually independent circuits inside the relevant constant voltage generation circuit 130. Note that, in the following description, in the case where it is unnecessary to specify which of the signals Vbs1 to Vbs4 the signal is, the relevant signal may be referred to as "a signal" followed by "Vbs" in parentheses, that is, "a signal (Com)".

In the present embodiment, the printing data SI, the control signals LAT and CH, the driving signals Com1 to Com4, and the signals Vbs1 to Vbs4 are supplied from the side of the control module 10 to the head module 5 via the FFC 190. Note that, in view of a direction in which current flows, the directions for the signals Vbs1 to Vbs4 are directions from the head module 5 toward the constant voltage generation circuit 130, but, for the sake of convenience, there are cases where an expression "the signals Vbs1 to Vbs4 are supplied to the head module 5" is used.

Further, in the FFC 190, the wirings for supplying the driving signals Com1 to Com4 and the signals Vbs1 to Vbs4 are arranged in the following order when seen from the side of the control module 10: Com1-Vbs1-Vbs2-Com2-Com3-Vbs3-Vbs4 Com4.

In the head module 5, the block B1 is supplied with a pair of the driving signal Com1 and the signal Vbs1. Similarly, the block B2 is supplied with a pair of the driving signal Com2 and the signal Vbs2; the block B3 is supplied with a pair of the driving signal Com3 and the signal Vbs3; and the block B4 is supplied with a pair of the driving signal Com4 and the signal Vbs4.

Here, since the individual blocks B1 to B4 are the same, for the sake of convenience, one block B1 will be described as a representative of them in the following description.

The block B1 includes a selection control portion 510 and m selection portions 520. Each of the selection portions 520 of the block B1 is provided in such a way as to be associated with a corresponding one of piezoelectric elements 37 associated with the respective nozzles belonging to the row L1, and is a switch that is turned On or Off in accordance with an instruction of the selection control portion 510. The input end of each of the selection portions 520 is supplied with the driving signal Com1, and the output end of the each of the selection portions 520 is connected to the first end of a corresponding one of the piezoelectric elements 37.

The selection control portion 510 controls the selections in the respective selection portions 520. More specifically, the selection control portion 510 stores therein the printing data SI supplied from the controller 110 once in such a way that each piece of printing data SI included in the printing data SI is associated with a corresponding one of the m nozzles N, and then, the selection control portion 510 instructs, in accordance with the each piece of printing data SI included in the printing data SI, the selection (On) or non-selection (Off) of the driving signal Com1 to a corresponding one of the selection portions 520 across a period prescribed by the control signals LAT and CH. In this case, the second ends of the m piezoelectric elements 37 corresponding to the block B1 are connected in common, and are supplied with the signal Vbs1.

Figure 7:
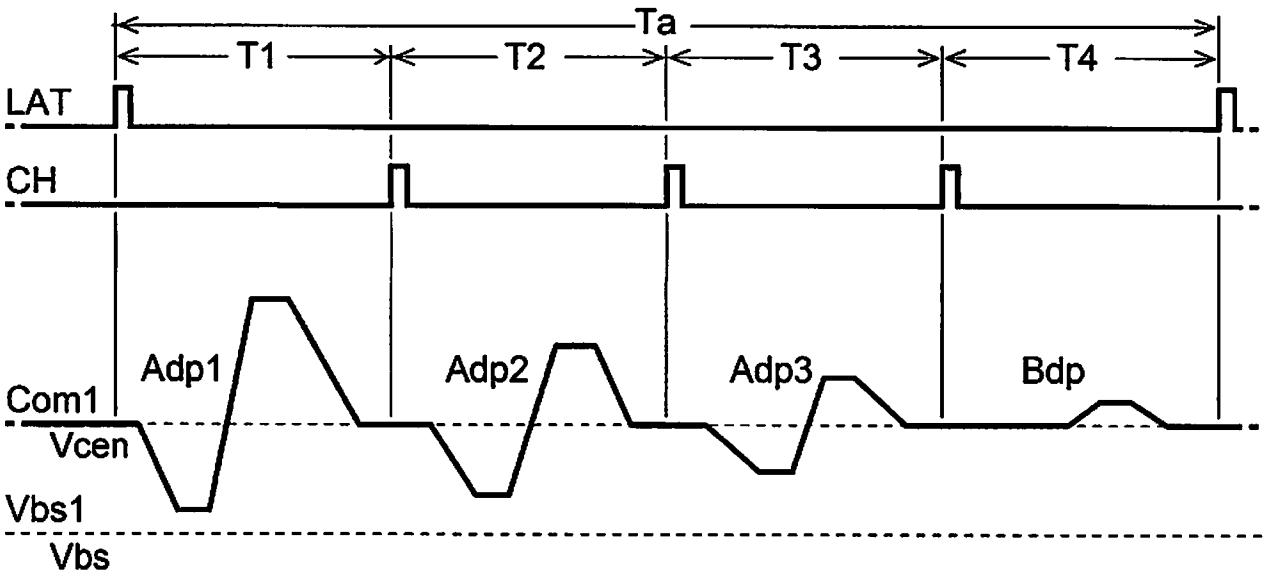
FIG. 7 is a timing chart illustrating the operation of the ink jet printer.

FIG. 7 is a timing chart illustrating the operation of the block B1. As illustrated in FIG. 7, a printing period Ta and control periods T1, T2, T3, and T4 are defined by the control signals LAT and CH.

Here, the printing period Ta is a period from the output of a control signal LAT until the output of a next control signal LAT, and means a unit period that is needed for an ink ejected through one nozzle N to represent any one of the four grayscale levels. The control period T1 is a period from the output of the control signal LAT until the output of a first control signal CH; the control period T2 is a period from the output of the first control signal CH until the output of a second control signal CH; the control period T3 is a period from the output of the second control signal CH until the output of a third control signal CH; and the control period T4 is a period from the output of the third control signal CH until the output of the next control signal LAT.

Meanwhile, the driving signal Com1 has a waveform obtained by repeating a trapezoidal waveform Adp1, namely, a trapezoidal waveform arranged during the control period T1; a trapezoidal waveform Adp2, namely, a trapezoidal waveform arranged during the control period T2; a trapezoidal waveform Adp3, namely, a trapezoidal waveform arranged during the control period T3; a trapezoidal waveform Bdp, namely, a trapezoidal waveform arranged during the control period T4.

In the present embodiment, the trapezoidal waveform Adp1 is a waveform that, if supplied to the first end of a piezoelectric element 37, allows a large amount of ink to be ejected through a nozzle N corresponding to the relevant piezoelectric element 37. The trapezoidal waveform Adp2 is a waveform that, if supplied to the first end of a piezoelectric element 37, allows a medium amount of ink to be ejected through a nozzle N corresponding to the relevant piezoelectric element 37. The trapezoidal waveform Adp3 is a waveform that, if supplied to the first end of a piezoelectric element 37, allows a small amount of ink to be ejected through a nozzle N corresponding to the relevant piezoelectric element 37. The trapezoidal waveform Bdp is a waveform that allows ink existing in the vicinity of a nozzle N to slightly vibrate to prevent the increase of the viscosity of the ink. Thus, even when the trapezoidal waveform Bdp is supplied to the first end of a piezoelectric element 37, no ink is ejected through a nozzle N corresponding to the relevant piezoelectric element 37.

FIG. 8 is a diagram illustrating the operation of the selection portion 520 for the piece of printing data SI.

As described above, the piece of printing data SI corresponding to one nozzle prescribes any one of the four grayscale levels using two bits.

In the case where the piece of printing data SI corresponding to a certain nozzle N is represented by (1, 1), and prescribes the size of a large dot, the selection control portion 510 causes a selection portion 520 corresponding to the relevant nozzle N to be turned On during the control period T1, and be turned Off during each of the control periods T2, T3, and T4. Thus, the trapezoidal waveform Adp1 is supplied to the first end of a piezoelectric element 37 corresponding to the relevant nozzle N during the control period T1, thereby causing a large amount of ink to be ejected through the relevant nozzle N, and as a result, a large dot is formed on the medium P.

Further, in the case where the piece of printing data SI corresponding to a certain nozzle N is represented by (0, 1), and prescribes the size of an medium dot, the selection control portion 510 causes a selection portion 520 corresponding to the relevant nozzle N to be turned On during the control period T2, and be turned Off during each of the control periods T1, T3, and T4. Thus, the trapezoidal waveform Adp2 is supplied to the first end of a piezoelectric element 37 corresponding to the relevant nozzle N during the control period T2, thereby causing a medium amount of ink to be ejected through the relevant nozzle N, and as a result, a medium dot is formed on the medium P.

Meanwhile, in the case where the piece of printing data SI corresponding to a certain nozzle N is represented by (1, 0), and prescribes the size of a small dot, the selection control portion 510 causes a selection portion 520 corresponding to the relevant nozzle N to be turned On during the control period T3, and be turned Off during each of the control periods T1, T2, and T4. Thus, the trapezoidal waveform Adp3 is supplied to the first end of a piezoelectric element 37 corresponding to the relevant nozzle N during the control period T3, thereby causing a small amount of ink to be ejected through the relevant nozzle N, and as a result, a small dot is formed on the medium P.

Further, in the case where the piece of printing data SI corresponding to a certain nozzle N is represented by (0, 0), and prescribes no dot formation, the selection control portion 510 causes a selection portion 520 corresponding to the relevant nozzle N to be turned On during the control period T4, and be turned Off during each of the control periods T1, T2, and T3. Thus, the trapezoidal waveform Bdp is supplied to the first end of a piezoelectric element 37 corresponding to the relevant nozzle N during the control period T4, thereby causing no ink to be ejected through the relevant nozzle N, and as a result, no dot is formed on the medium P.

Note that the operation of the block B1 has been described heretofore as a representative of the operations of the blocks B1 to B4, and the operation of each of the blocks B2, B3, and B4 is similar to that of the block B1. That is, the block B2 (B3, B4) is supplied with pieces of printing data SI each of which prescribes a dot to be formed through a corresponding one of the m nozzles N corresponding to the row L2 (L3, L4), and a pair of the driving signal Com2 and the signal Vbs2 (a pair of the driving signal Com3 and the signal Vbs3, a pair of the driving signal Com4 and the signal Vbs4).

Figure 9:
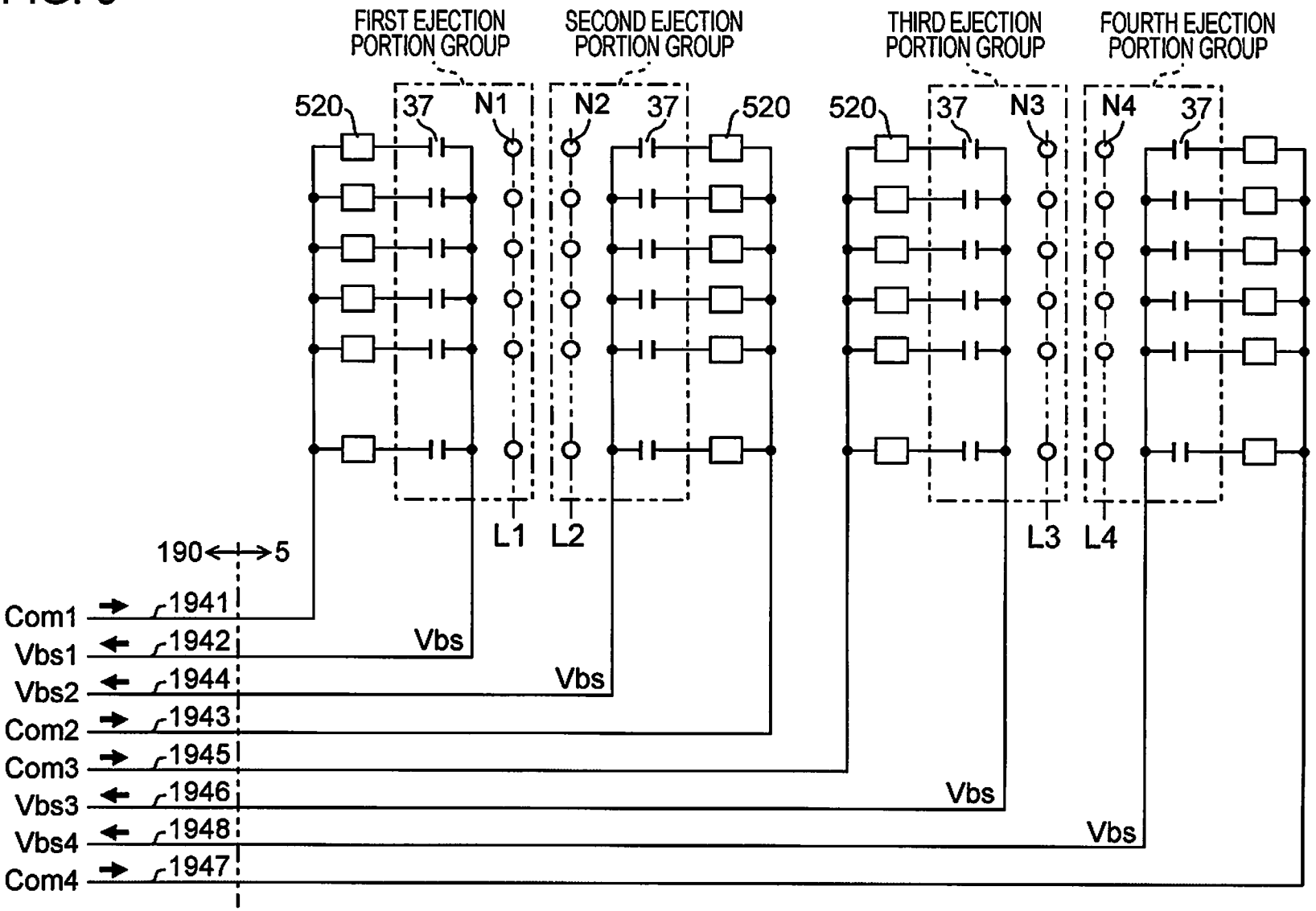
FIG. 9 is a diagram illustrating a simplified equivalent circuit when the head module is seen from an FFC.
Figure 10:
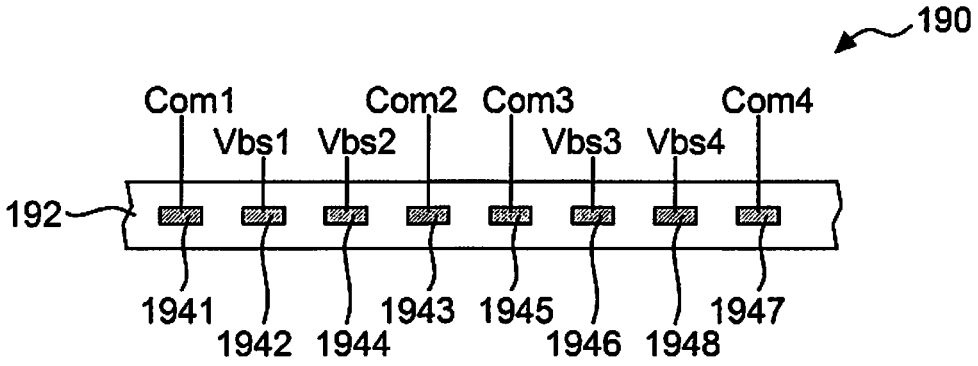
FIG. 10 is a diagram illustrating the wiring arrangement of the FFC, according to the embodiment.

FIG. 9 is a diagram illustrating an equivalent circuit of a portion from the FFC 190 up to the head module 5, and FIG. 10 is a diagram illustrating a wiring arrangement in the FFC 190 when the wiring arrangement is seen from the side of the control module 10.

In FIG. 9, one pair of one of the nozzles N1 belonging to the row L1 and a piezoelectric elements 37 corresponding to the relevant nozzle N1 is referred to as a first ejection portion, and m first ejection portions are collectively referred to as a first ejection portion group. From a viewpoint of a physical mechanism for ejecting an ink, as described above, the ejection portion is constituted by one of the pressure chambers C, a corresponding one of the flow paths 322, a corresponding one of the nozzles N, the vibration portion 36, and a corresponding one of the piezoelectric elements 37, but, here, in order to describe the electric equivalent circuit, only one piezoelectric element 37 and one nozzle N corresponding to the relevant piezoelectric element 37 are illustrated.

Similarly, one pair of one of the nozzles N2 belonging to the row L2 and a corresponding one of the piezoelectric elements 37 is referred to as a second ejection portion, and m second ejection portions are collectively referred to as a second ejection portion group; one pair of one of the nozzles N3 belonging to the row L3 and a corresponding one of the piezoelectric elements 37 is referred to as a third ejection portion, and m third ejection portions are collectively referred to as a third ejection portion group; and one pair of one of the nozzles N4 belonging to the row L4 and a corresponding one of the piezoelectric elements 37 is referred to as a fourth ejection portion, and m fourth ejection portions are collectively referred to as a fourth ejection portion group.

As illustrated in FIG. 10, the FFC 190 has a structure in which a plurality of conductive materials, such as copper materials, each having a flat-shaped cross section are arranged in parallel to one another, and these conductive materials are coated by an insulating material 192, namely, an insulating material having flexibility. Here, when attention is paid to the driving signals Com1 to Com4 and the signals Vbs1 to Vbs4 among the signals supplied via the FFC 190, wirings for supplying these signals are arranged in the above-described order in the present embodiment.

Note that, in the FFC 190, the driving signal Com1 is supplied via a first wiring 1941. Similarly, the signal Vbs1 is supplied via a second wiring 1942; the driving signal Com2 is supplied via a third wiring 1943; the signal Vbs2 is supplied via a fourth wiring 1944; the driving signal Com3 is supplied via a fifth wiring 1945; the signal Vbs3 is supplied via a sixth wiring 1946; the driving signal Com4 is supplied via a seventh wiring 1947; and the signal Vbs4 is supplied via an eighth wiring 1948.

The first end of each of the m piezoelectric elements 37 in the first ejection portion group is supplied with one of the voltages of the driving signal Com1 via the first wiring 1941 upon turning On of a corresponding one of the selection portions 520. Meanwhile, the second ends of the respective m piezoelectric elements 37 in the first ejection portion group are connected in common, and are supplied with the electric potential Vbs of the signal Vbs1 via the second wiring 1942.

Thus, in the first ejection portion group, the larger the number of piezoelectric elements 37 that are among the m piezoelectric elements 37 and that are driven upon turning On of corresponding selection portions 520 is, the larger the amount of current flowing through the first wiring 1941 is; while the smaller the number of piezoelectric elements 37 that are among the m piezoelectric elements 37 and that are driven upon turning On of corresponding selection portions 520 is, the smaller the amount of current flowing through the first wiring 1941 is.

In this case, as described above, the direction of the current in the signal Vbs1 is the direction from the head module 5 toward the FFC 190. For this reason, in the FFC 190, upon supply of the driving signal Com1 to the head module 5 via the first wiring 1941, the signal Vbs1 is returned, as a return current corresponding to the driving signal Com1, to the control module 10 via the second wiring 1942. Accordingly, the amount of current flowing through the first wiring 1941 and the amount of current flowing through the second wiring 1942 are approximately the same, and the direction of the current flowing through the first wiring 1941 and the direction of the current flowing through the second wiring 1942 are opposite to each other.

Similarly, the first end of each of the m piezoelectric elements 37 in the second ejection portion group is supplied with one of the voltages of the driving signal Com2 via the third wiring 1943 upon turning On of a corresponding one of the selection portions 520. Meanwhile, the second ends of the respective m piezoelectric elements 37 are connected in common, and are supplied with the electric potential Vbs of the signal Vbs2 via the fourth wiring 1944.

Thus, in the second ejection portion group as well, the larger the number of piezoelectric elements 37 that are among the m piezoelectric elements 37 and that are driven upon turning On of corresponding selection portions 520 is, the larger the amount of current flowing through the third wiring 1943 is; while the smaller the number of piezoelectric elements 37 that are among the m piezoelectric elements 37 and that are driven upon turning On of corresponding selection portions 520 is, the smaller the amount of current flowing through the third wiring 1943 is.

In this case, in the FFC 190, the amount of current flowing through the third wiring 1943 and the amount of current flowing through the fourth wiring 1944 are approximately the same, and the direction of the current flowing through the third wiring 1943 and the direction of the current flowing through the fourth wiring 1944 are opposite to each other. Similarly, the amount of current flowing through the fifth wiring 1945 and the amount of current flowing through the sixth wiring 1946 are approximately the same, and the direction of the current flowing through the fifth wiring 1945 and the direction of the current flowing through the sixth wiring 1946 are opposite to each other; and the amount of current flowing through the seventh wiring 1947 and the amount of current flowing through the eighth wiring 1948 are approximately the same, and the direction of the current flowing through the seventh wiring 1947 and the direction of the current flowing through the eighth wiring 1948 are opposite to each other.

Before the description of advantageous effects of the present embodiment, a comparison example will be described below.

Figure 13:
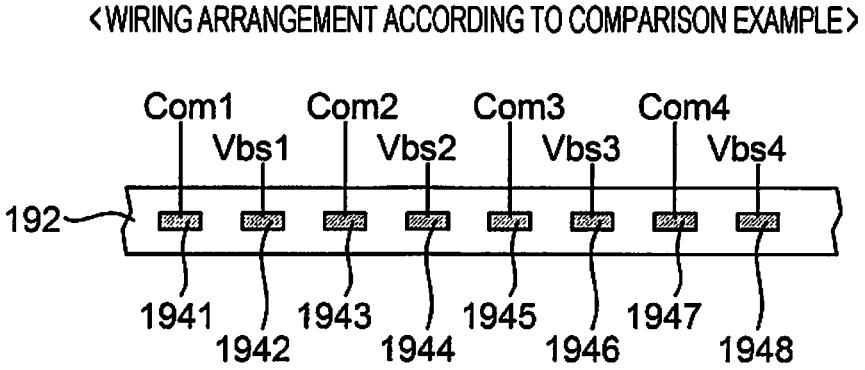
FIG. 13 is a diagram illustrating the wiring arrangement of an FFC, according to a comparison embodiment.

FIG. 13 is a diagram illustrating the wiring arrangement of an FFC in a comparison example, and in FIG. 13, a wiring for supplying a driving signal and a wiring for a constant electric potential are arranged adjacent to each other. More specifically, in the comparison example, the individual wirings for supplying the driving signals Com1 to Com4 and the signals Vbs1 to Vbs4 are arranged in the following order. That is, the individual wirings are arranged in order as follows: Com1-Vbs1-Com2-Vbs2-Com3-Vbs3-Com4-Vbs4.

In general, when current flows through a straight-line shaped conductive material, a magnetic field is produced by the current on a concentric circle having a center at the conductive material. In this case, when the amount of the current and the magnitude of the magnetic field on the concentric circle are respectively denoted by I [A] and H [A/m], and a distance from the conductive material to the concentric circle (namely, the radius of the concentric circle) is represented by r [m], the magnitude H of the magnetic field is represented by the following formula (1).

$$H=I/2\pi r \quad (1)$$

That is, the magnitude H of the magnetic field is proportional to the mount I of the current, and is inversely proportional to the distance r from the conductive material.

Here, a wiring pitch in the FFC is assumed to be "1" for the simplification of the description, and the magnitude of a magnetic field received by any one wiring from any other wiring (namely, a degree of influence on any one wiring from any other wiring) will be considered.

FIG. 14 is a diagram illustrating, for each of the wiring signals, degrees of influence received from individual wiring signals other than the each of the wiring signals, in the comparison example. Note that, in the degrees of influence illustrated in FIG. 14, the coefficient $1/2\pi$ in the right side of the formula (1) is not taken into the consideration because the coefficient $1/2\pi$ appears in common. Further, the amounts of inks ejected through the nozzles N belonging to the rows L1 to L4 depend on and are determined by images to be printed, and thus, it is not simple and is rather difficult to make a comparison among the amounts of currents corresponding to the respective driving signals Com1 to Com4. For this reason, the amount I of the current in the right side of the formula (1) is also not taken into the consideration.

In this case, as described above, for a driving signal (Com) and a signal (Vbs) that are included in the same pair, the amount of current corresponding to the driving signal (Com) and the amount of current corresponding to the signal (Vbs) are approximately the same, and the direction of the current corresponding to the driving signal (Com) and the direction of the current corresponding to the signal (Vbs) are opposite to each other. Thus, the degree of influence between the driving signal (Com) and the signal (Vbs) that are included in the same pair is deemed to be "0". For example, the degree of influence on the signal Vbs1 when seen from the driving signal Com1 is "0", and the degree of influence on the driving signal Com1 when seen from the signal Vbs1 is also "0".

Further, when attention is paid to a certain wiring signal, the denominator of the degree of influence received from each of the other wiring signals increases in order of "1", "2", "3", . . . "7" along with the increase of the distance between the certain wiring signal and the each of the other wiring signals, and the sign of the degree of influence for each of the other wiring signals is represented by a negative sign in the case where the direction of current corresponding to the each of the other wiring signals is opposite to the direction of current corresponding to the certain wiring signal.

For example, when attention is paid to the driving signal Com3, the degree of influence from the signal Vbs2 is indicated as "−1" because the direction of current corresponding to the signal Vbs2 is opposite to the direction of current corresponding to the driving signal Com3, and the distance between the wirings for the driving signal Com3 and the signal Vbs2 is "1". Further, when attention is paid to the driving signal Com2, the degree of influence from the driving signal Com4 is indicated as "1/4" because the direction of current corresponding to the driving signal Com4 is the same as the direction of current corresponding to the driving signal Com2, and the distance between the wirings for the driving signal Com2 and the driving signal Com4 is "4".

Next, the degrees of influence received by each of the driving signals Com1 to Com4 from relevant pairs will be considered.

FIG. 15 is a diagram illustrating the degrees of influence received by each of the driving signals Com1 to Com4 from relevant pairs, in a comparison example. Note that each of the degrees of influence illustrated in FIG. 15 indicates the summation of a first degree of influence received by a certain driving signal (Com) from another driving signal (Com) and a second degree of influence received by the certain driving signal (Com) from a signal (Vbs), the another driving signal (Com) and the signal (Vbs) forming a pair other than a pair including the certain driving signal (Com). Note that, in FIG. 14, the above first and second degrees of influence, which are targets of the summation, are enclosed by a dashed line.

For example, the degree of influence received by the driving signal Com2 from a pair of the driving signal Com4 and the signal Vbs4 is "1/20" resulting from the summation of "1/4" and "−1/5". Further, for example, the degree of influence received by the driving signal Com4 from a pair of the driving signal Com1 and the signal Vbs1 is "−1/30" resulting from the summation of "1/6" and "−1/5".

Note that the bottom field of FIG. 15 indicates, for each of the driving signals Com1 to Com4, the total of the degrees of influence received by the each of the driving signals Com1 to Com4 from pairs other than a pair including the each of the driving signals Com1 to Com4, in the comparison example.

Here, a reason why attention is paid to each of the driving signals Com1 to Com4 (that is, a reason why attention is not paid to each of the signals Vbs1 to Vbs4) is that, as described above, each of the driving signals Com1 to Com4 is a voltage having a trapezoidal waveform, and when the voltage is changed, a waveform deformation, such as overshooting, undershooting, or the like, is likely to occur due to influence of magnetic fields of other wirings (mutual inductance); while, since each of the signals Vbs1 to Vbs4 originally has a constant electric potential Vbs, the occurrence of such overshooting or the like on the each of the signals Vbs1 and Vbs4 due to the voltage change is not needed to be considered.

The superior points of the present embodiment in comparison with the above comparison example will be described.

FIG. 11 is a diagram illustrating, for each of the wiring signals, the degrees of influence received from individual wiring signals other than the each of the wiring signals, in the present embodiment. Note that, although the method of calculating the degrees of influence in FIG. 11 is the same as that in the case of FIG. 14, inversion patterns for the positive/negative signs of the degrees of influence in the present embodiment are different from those in the comparison example because the wiring arrangement in the FFC 190 of the present embodiment is different from that in the FFC of the comparison example. More specifically, when attention is paid to fields of a horizontal row or fields of a vertical column in the table illustrated in FIG. 11, the positive sign or the negative sign alternately appears in the comparison example of FIG. 14; while the positive sign or the negative sign appears every third field in the present embodiment of FIG. 11.

FIG. 12 is a diagram illustrating the degrees of influence received by each of the driving signals Com1 to Com4 from relevant pairs, in the present embodiment. Note that the method of calculating the degrees of influence in FIG. 12 is the same as that in the case of FIG. 15.

Note that the bottom field of FIG. 12 indicates, for each of the driving signals Com1 to Com4, the total of the degrees of influence received by the each of the driving signals Com1 to Com4 from pairs other than a pair including the each of the driving signals Com1 to Com4, in the present embodiment. As illustrated in the bottom field of the FIG. 12, for each of the driving signals Com1 to Com4, the absolute value of the total of degrees of influence received by the each of the driving signals Com1 to Com4 from pairs other than the pair including the each of the driving signals Com1 to Com4 is made small, as compared with the comparison example illustrated in FIG. 15.

The reason for this result is that, for example, in FIG. 13 and FIG. 10, for a certain driving signal (Com) among the driving signals Com1 to Com4, when attention is paid to degrees of influence of other two or more pairs located on the left side or the right side of a wiring through which the certain driving signal (Com) is supplied, as understood referring to FIG. 15, in the comparison example, all of the relevant degrees of influence have only either positive signs or negative signs, thereby merely causing the absolute value of the total of the relevant degrees of influence to be increased; while, in the present embodiment, as understood referring to FIG. 12, for the relevant degrees of influence, a positive sign and a negative sign surely alternately appear, thereby allowing the relevant degrees of influence to be mutually compensated for.

Accordingly, in the present embodiment, for each of the first wiring 1941, the third wiring 1943, the fifth wiring 1945, and the seventh wiring 1947, which are for use in supplying driving signals (Com), the influence of mutual inductance from wirings for supplying other signals is reduced, and thus, this reduction of the influence of the mutual inductance enables the prevention of the ejection failure due to the waveform deformation, such as overshooting, undershooting, or the like, as well as the prevention of the occurrence of a problem in that an overvoltage is applied to the piezoelectric element 37 due to the overshooting or the like.

In this respect, it is pointed out that, when the overvoltage is applied to the piezoelectric element 37, there is a possibility that the following failures may occur. That is, when the overvoltage is applied to the piezoelectric element 37, there is a possibility that the piezoelectric element 37 may be deformed beyond its allowable deformation limit, and thereby, a failure with respect to the piezoelectric element 37, such as a delamination failure, a breakage failure, or the like, may occur.

Further, when the overvoltage is applied to the piezoelectric element 37, it follows that a reverse voltage is applied to a voltage for polling processing, and thereby, a stress concentration arises in the piezoelectric material of the piezoelectric element 37. Further, this stress concentration causes a crack or the like to arise in the piezoelectric material, thereby causing the performance of the piezoelectric element 37 to be deteriorated. Thus, there is a possibility that a failure, such as abnormality in the deformation of the piezoelectric element 37 in conjunction with the voltage change, or the like, may occur. In this respect, in the present embodiment, the problem in that the overvoltage due to the overshooting or the like is applied to the piezoelectric element 37 is prevented, and thus, the above-described failures with respect to the piezoelectric element 37 can be reduced.

The above embodiment can be variously modified. Specific configuration modifications will be exemplified below. Two or more configurations that are optionally selected from among exemplifications below can be appropriately combined within a scope where there is no inconsistency among the relevant two or more configurations. Note that, in modification examples exemplified below, for elements whose actions or functions are the same as or similar to those of the elements of the above embodiment, reference signs having been referred to in the description of the above embodiment will be also used, and thereby, the detailed descriptions of the relevant elements will be appropriately omitted.

In the above description, the configuration in which the printing period Ta is divided into the four control periods, namely, the control periods T1, T2, T3, and T4, and in each of the control periods, it is controlled whether or not a driving signal (Com) is applied to the first end of the piezoelectric element 37 is employed, but the number of the divisions of the printing period Ta is not limited to "4" in the above description. Further, the number of the print heads 50 in the head module 5 is not limited to "2", and further, the number of the rows of nozzles is not limited to "4".

In the above-described embodiment, the ink jet printer 1 has been described using a serial printer as an example of the ink jet printer 1, but the ink jet printer 1 is not limited to the configuration of such a serial printer. For example, the ink jet printer 1 may be a so-called line printer configured to allow the print head 50 to be provided in such a way that the plurality of nozzles N extends more widely than the width of the medium P.

What is claimed is:

1. A liquid ejecting apparatus comprising:

a first ejection portion group including a plurality of first piezoelectric elements, each of the first piezoelectric elements being coupled to a first ejection portion configured to eject a first liquid in conjunction with driving of the each first piezoelectric element;

a second ejection portion group including a plurality of second piezoelectric elements, each of the second piezoelectric elements being coupled to a second ejection portion configured to eject a second liquid in conjunction with driving of the each second piezoelectric element;

a first wiring connected to a first end of the each first piezoelectric element to supply a drive signal to drive the each first piezoelectric element;

a second wiring connected to a second end of the each first piezoelectric element to supply a signal having a predetermined electric potential to maintain an electric potential of the second end of the each first piezoelectric element;

a third wiring connected to a first end of the each second piezoelectric element to supply a drive signal to drive the each second piezoelectric element; and a fourth wiring connected to a second end of the each second piezoelectric element to supply a signal having a predetermined electric potential to maintain an electric potential of the second end of the each second piezoelectric element, wherein the second wiring is arranged between the first wiring and the fourth wiring, the fourth wiring is arranged between the second wiring and the third wiring, and the second wiring and the fourth wiring are arranged between the first wiring and the third wiring.

2. The liquid ejecting apparatus according to claim 1, wherein the first wiring, the second wiring, the third wiring, and the fourth wiring are included in one flexible flat cable.

3. The liquid ejecting apparatus according to claim 1, wherein the first wiring is a wiring for supplying the driving signal to the each first piezoelectric element, and an amount of current flowing through the first wiring varies in accordance with a total number of piezoelectric elements which are included in the plurality of first piezoelectric elements and each of which is a target of the driving.

4. The liquid ejecting apparatus according to claim 3, wherein the first ejection portion includes at least three hundred first ejection portions.

5. The liquid ejecting apparatus according to claim 1, wherein the first ejection portion and the second ejection portion are configured to, while being moved relatively to each other, respectively eject the first liquid and the second liquid onto a medium having a size larger than or equal to a size A3.

6. The liquid ejecting apparatus according to claim 1, wherein the second wiring is the only wiring for supplying the signal having the predetermined electric potential to the electric potential of another end of the each first piezoelectric element, and the fourth wiring the only wiring for supplying the signal having the predetermined electric potential to maintain the electric potential of another end of the each second piezoelectric element.

7. The liquid ejecting apparatus according to claim 1, wherein the first wiring, the second wiring, the third wiring and the fourth wiring extend parallel to each other along a first direction, and overlap each other when viewed along a second direction perpendicular to the first direction.

8. The liquid ejecting apparatus according to claim 1, further comprising:

a third ejection portion group including a plurality of third piezoelectric elements, each of the third piezoelectric elements being coupled to a third ejection portion configured to eject a third liquid in conjunction with driving of the each third piezoelectric element;

a fifth wiring connected to a first end of the each third piezoelectric element to supply a drive signal to drive the each third piezoelectric element;

a sixth wiring connected to a second end of the each third piezoelectric element to supply a signal having a predetermined electric potential to maintain an electric potential of the second end of the each third piezoelectric element, wherein the fifth wiring is arranged next to the third wiring, and the third wiring and the fifth wiring are arranged between the fourth wiring and the sixth wiring.

9. The liquid ejecting apparatus according to claim 7, further comprising:

a fourth ejection portion group including a plurality of fourth piezoelectric elements, each of the fourth piezoelectric elements being coupled to a fourth ejection portion configured to eject a fourth liquid in conjunction with driving of the each fourth piezoelectric element;

a seventh wiring connected to a first end of the each fourth piezoelectric element to supply a drive signal to drive the each fourth piezoelectric element;

a eighth wiring connected to a second end of the each fourth piezoelectric element to supply a signal having a predetermined electric potential to maintain an electric potential of the second end of the each fourth piezoelectric element, wherein the sixth wiring is arranged between the fifth wiring and the eighth wiring, the eighth wiring is arranged between the sixth wiring and the seventh wiring, and the sixth wiring and the eighth wiring are arranged between the fifth wiring and the seventh wiring.

* * * * *